US007427089B2

(12) United States Patent
Silverio et al.

(10) Patent No.: US 7,427,089 B2
(45) Date of Patent: Sep. 23, 2008

(54) APPARATUS AND METHOD FOR SECURING A HATCH COVER TO A HATCH PORT

(75) Inventors: Joseph Robert Silverio, St. Peters, MO (US); Glenn Allen Sandheinrich, Belleville, IL (US)

(73) Assignee: American Railcar Industries, Inc., St. Charles, MO (US)

( * ) Notice: Subject to any disclaimer, the term of this patent is extended or adjusted under 35 U.S.C. 154(b) by 117 days.

(21) Appl. No.: 11/194,379

(22) Filed: Aug. 1, 2005

(65) Prior Publication Data

US 2007/0024063 A1 Feb. 1, 2007

(51) Int. Cl.
*B65D 45/00* (2006.01)

(52) U.S. Cl. ..... 292/256.5; 292/256; 105/377.11

(58) Field of Classification Search ..... 292/256.5, 292/256; 105/377.05, 377.01, 377.06, 377.07, 105/377.11 X See application file for complete search history.

(56) References Cited

U.S. PATENT DOCUMENTS 3,786,955 A * 1/1974 Mowatt-Larssen ..... 220/327
4,248,160 A * 2/1981 Carney et al. ..... 105/377.11
4,411,371 A 10/1983 Collier et al.
4,441,431 A * 4/1984 Carney et al. ..... 105/377.11
4,570,816 A 2/1986 Ferris et al.
4,635,979 A 1/1987 Blume
4,690,070 A 9/1987 Miller
4,941,695 A 7/1990 Miller
4,948,185 A 8/1990 Miller
5,158,022 A * 10/1992 Dugge et al. ..... 105/377.07
5,366,317 A 11/1994 Solimar
5,438,935 A * 8/1995 Seitz ..... 105/377.11
5,785,362 A 7/1998 Nadherny
5,937,581 A 8/1999 Matye et al.
6,039,362 A 3/2000 Nadherny
6,095,365 A 8/2000 Yielding
6,296,135 B1 10/2001 Anderson et al.
6,595,716 B1 * 7/2003 VanDeVyvere et al. ..... 404/26
7,131,455 B2 * 11/2006 Horban et al. ..... 137/350

* cited by examiner

*Primary Examiner*—Patricia Engle
*Assistant Examiner*—Mark Williams
(74) *Attorney, Agent, or Firm*—Armstrong Teasdale LLP

(57) ABSTRACT

A hatch cover assembly for covering an opening in a vessel wherein a hatch port extends outwardly about the opening includes a hatch cover hingedly attached to the hatch port, and at least one latch assembly for fastening the hatch cover to the hatch port. The latch assembly includes a cam mount extending from the hatch port, and a first cam pin coupled to the cam mount. The first cam pin has a pin axis. A bolt member includes a first end and a second end, and the bolt member has a centerline axis extending between the first end and the second end. The centerline axis is generally perpendicular to the pin axis, and the first end is hingedly attached to the first cam pin about the pin axis. A securing member is in threaded relationship with the bolt member second end. The securing member is rotatable about the centerline axis of the bolt member. A cam member includes a cam lever portion and a clevis portion. The cam member is coupled to the bolt member by the securing member, and the cam member is configured to engage the securing member and adjust the threaded relationship of the securing member with respect to the bolt member by rotating the lever portion about the centerline axis of the bolt member.

9 Claims, 4 Drawing Sheets

APPARATUS AND METHOD FOR SECURING A HATCH COVER TO A HATCH PORT

BACKGROUND OF THE INVENTION

This invention relates generally to hatch covers and, more particularly, to methods and apparatus for securing a hatch cover in a locked position.

Railroad cars generally have one or more compartments for storing and transporting materials. Each compartment is generally provided with one or more openings or hatch ports. Hatch ports are provided for loading the compartment with product and are usually located at the top of the compartment. Hatch ports usually have a circular cross-sectional shape and are frequently provided with a collar extending outwardly about the periphery of the hatch port. A hatch cover is provided to close or seal the hatch port.

Known hatch covers are hinged at one side so as to pivot about a first axis, such as the horizontal axis. A latch assembly is mounted to the collar of the hatch port for securing and locking the hatch cover to the collar. With at least some known latch assemblies, a worker manually closes the hatch cover onto the collar to close the hatch port. The worker then rotates a lever of the latch assembly so that a portion of the lever extends over the hatch cover and prevents the hatch from lifting off the hatch port.

To tighten the fit between the hatch cover and the collar of the hatch port, a worker typically rotates the lever about a second axis, such as the vertical axis, before rotating the lever onto the hatch cover. In some known latch assemblies, the lever is rotated about the second axis to either tighten or loosen a screw for adjusting the distance between the lever and the hatch cover.

After adjustment of the distance between the lever and the hatch cover, the worker rotates the lever while the lever bears against the hatch cover, from an unlocked position in which the lever does not contact the hatch cover to a locked position in which the lever contacts and bears against the hatch cover. A separate tool may be required to tighten the latch assembly and center the lever before the lever is rotated into the locked position.

BRIEF DESCRIPTION OF THE INVENTION

In one aspect, a method for securing a hatch using a latch assembly is provided. The hatch is sized to cover a hatch port extending outwardly about an opening in a vessel. The latch assembly has a cam member and a bolt member, wherein the cam member has a cam lever portion and a clevis portion, and the bolt member has a first axis extending between a first end and a second end. The first end is hingedly attached to the hatch port about a second axis that is generally perpendicular to the first axis, and the second end is in a threaded relationship with a securing member. The clevis portion is configured to be rotationally engageable with the securing member about the first axis. The method includes positioning the latch assembly relative to the hatch by rotating the latch assembly about the second axis, engaging the securing member with the clevis portion of the cam member, rotating the lever portion of the cam member about the first axis to adjust the threaded relationship between the securing member and the bolt member, and pivoting the lever portion towards the hatch until the lever arm is in a locked position for securing the hatch to the hatch port.

In another aspect, a hatch cover assembly for covering an opening in a vessel is provided, wherein a hatch port extends outwardly about the opening. The hatch cover assembly includes a hatch cover hingedly attached to the hatch port, and at least one latch assembly for fastening the hatch cover to the hatch port. The latch assembly includes a cam mount extending from the hatch port, and a first cam pin coupled to the cam mount. The first cam pin has a pin axis. A bolt member includes a first end and a second end, and the bolt member has a centerline axis extending between the first end and the second end. The centerline axis is generally perpendicular to the pin axis, and the first end is hingedly attached to the first cam pin about the pin axis. A securing member is in threaded relationship with the bolt member second end. The securing member is rotatable about the centerline axis of the bolt member. A cam member includes a cam lever portion and a clevis portion. The cam member is coupled to the bolt member by the securing member, and the cam member is configured to engage the securing member and adjust the threaded relationship of the securing member with respect to the bolt member by rotating the lever portion about the centerline axis of the bolt member.

In a further aspect, a latch assembly is provided including a cam mount having a first cam pin extending therethrough, and a cam shaft having a first end and a second end. The cam shaft has a centerline axis extending between the first end and the second end. The first end includes an opening for receiving the first cam pin and for securing the cam shaft to the cam mount, and the second end includes a threaded portion for threaded engagement with a securing member. A cam member includes a lever end, a clevis end and a cam member axis extending therebetween. The second end of the cam shaft extends substantially perpendicular through the clevis end. The clevis end has an opening including an engagement portion sized to receive the securing member and the securing member is configured to couple the cam member to the cam shaft. The engagement portion is rotationally engageable with the securing member about the centerline axis for adjusting the threaded relationship between the cam shaft and the securing member.

DETAILED DESCRIPTION OF THE INVENTION

Figure 1:
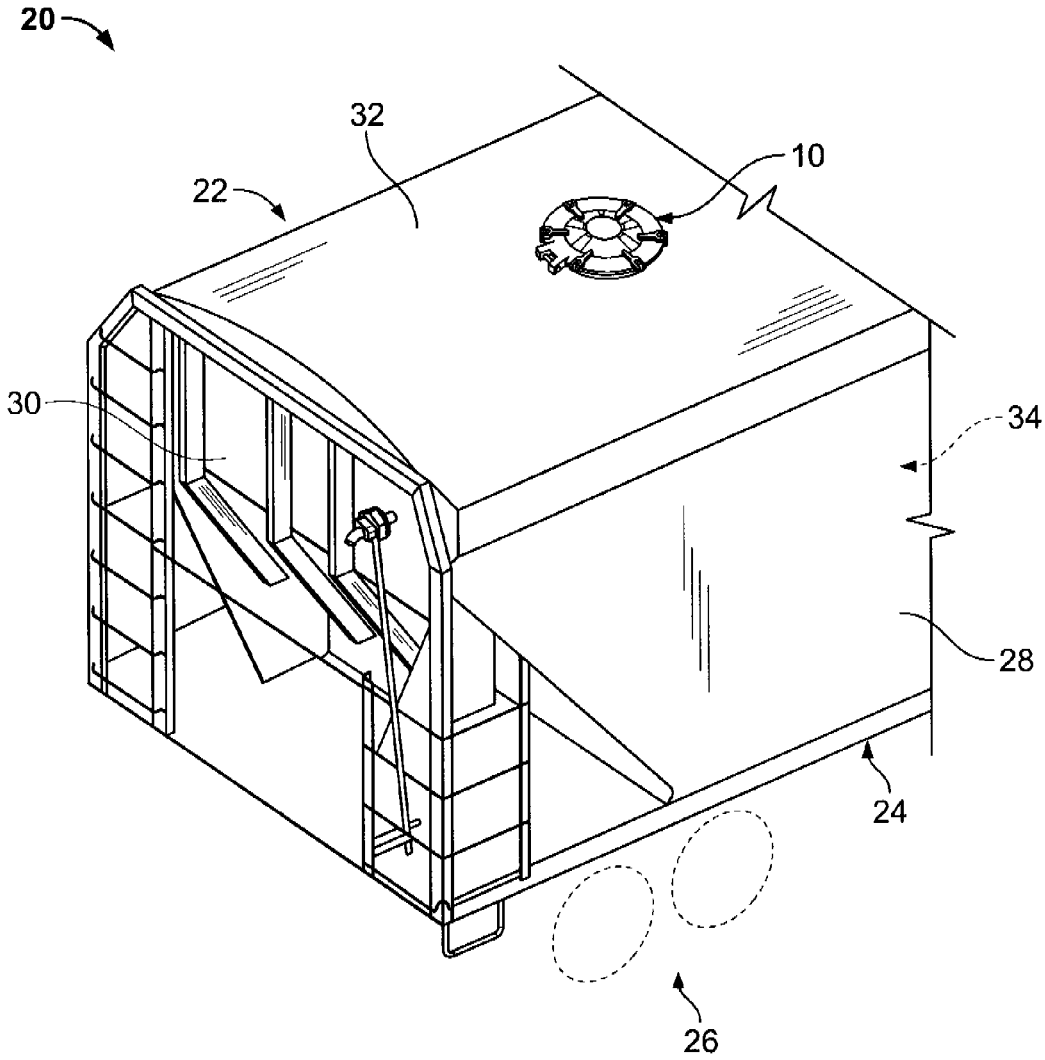
FIG. 1 is a perspective view of a railcar with at least one hatch assembly.

FIG. 1 is a perspective view of a hatch assembly 10 shown mounted on a conventional railroad car 20 that carries materials. While hatch assembly 10 is illustrated and described as being mounted on railcar 20, hatch assembly 10 is not limited to such mountings. Rather, hatch assembly 10 may be mounted on other hoppers or vessels used for storing liquid or solid materials, such as, for example, but not limited to, over the road trucks, stationary tanks or other similar types of vessels.

The car 20 includes a frame 22 having a side sill 24 mounted on conventional trucks 26, a pair of opposed side walls 28 extending upwardly from the side sill 24, a pair of opposed end walls 30 extending upwardly from the side sill 24, and a top 32 supported by the walls 28 and 30. A plurality of compartments 34 for storing particulate material being transported are defined by the side sill 24, side walls 28, end walls 30, and top 32. Additionally, in one embodiment, compartments 34 are further defined by a trapezoidal shaped bottom (not shown) for directing material to a discharge opening (not shown). In another embodiment, compartments 34 may have a conical shaped bottom or other shape that facilitates directing material contained within the compartments to a discharge opening.

Figure 2:
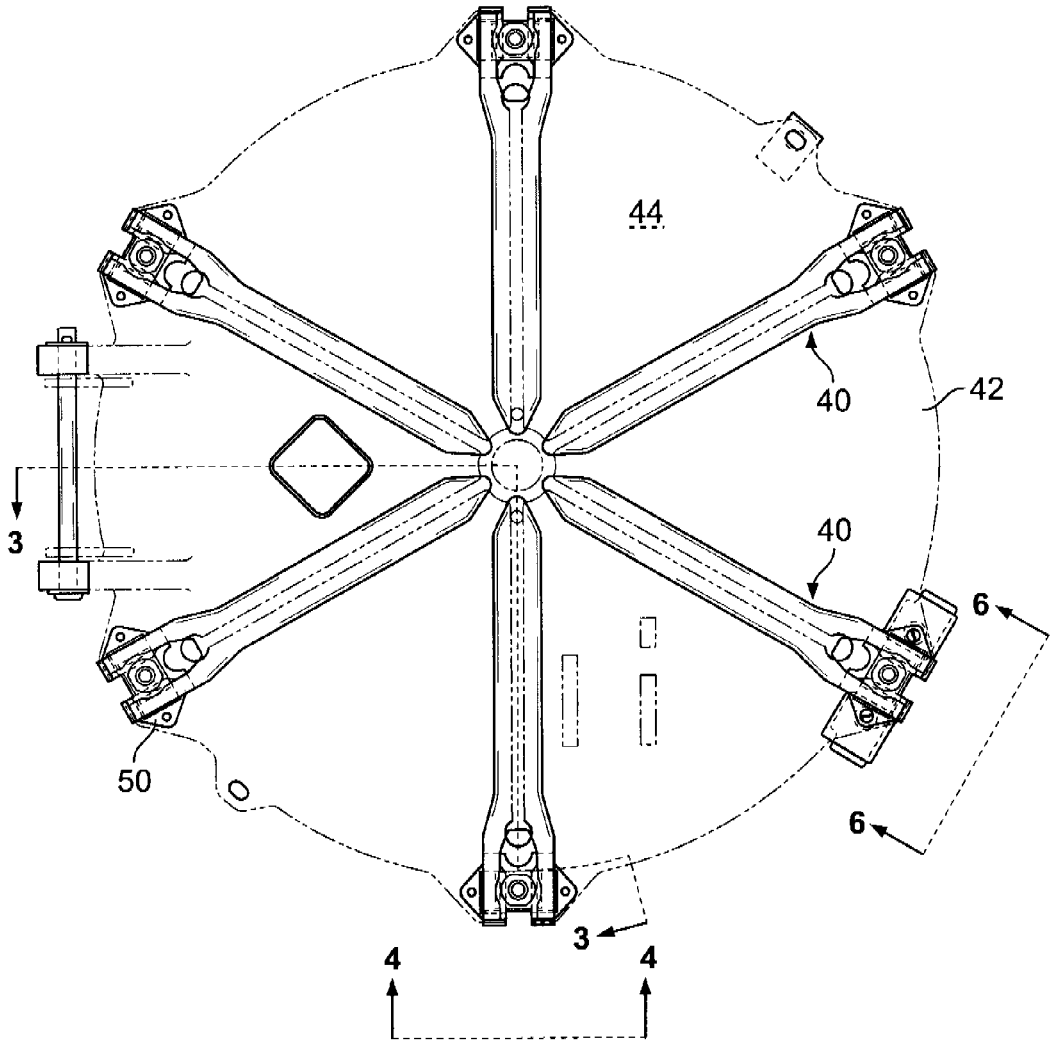
FIG. 2 is a top view of the hatch assembly shown in FIG. 1 in a closed and locked position.
Figure 3:
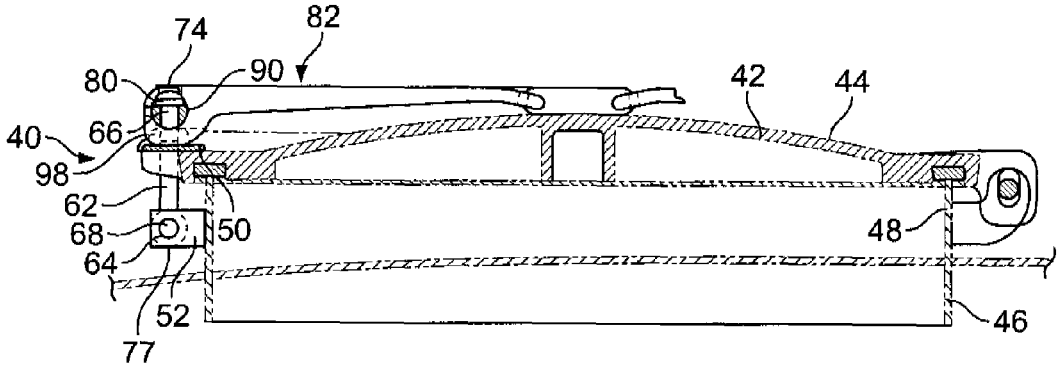
FIG. 3 is a side perspective view of the hatch assembly shown in FIG. 2 illustrating an exemplary latch assembly.
Figure 4:
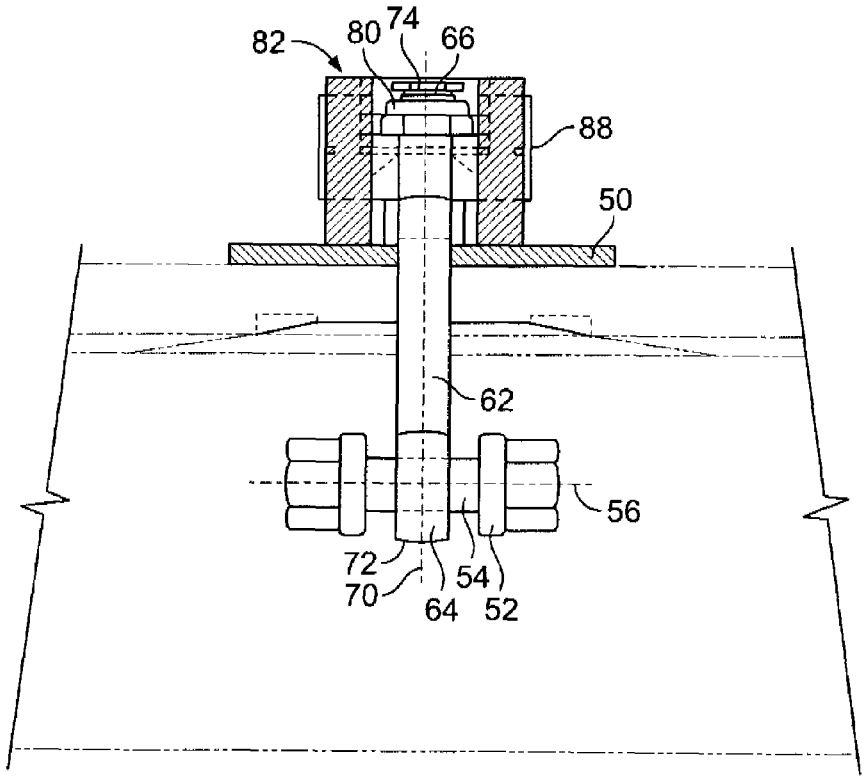
FIG. 4 is a front perspective view of the latch assembly shown in FIG. 3 in a closed and locked position.
Figure 5:
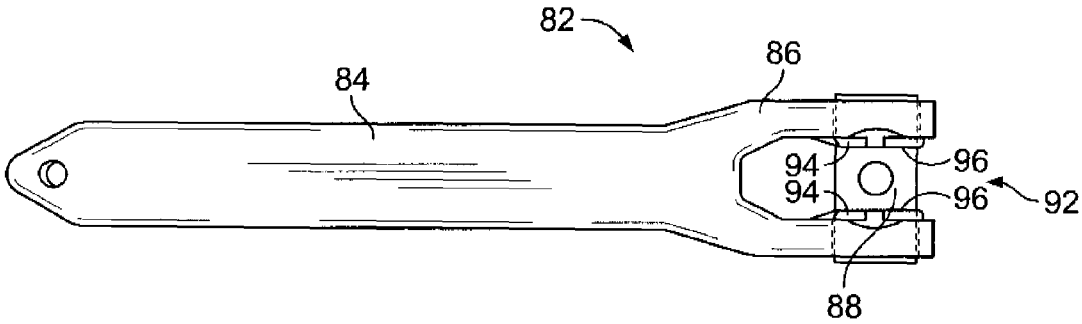
FIG. 5 is a plan view of a cam member for use with the latch assembly shown in FIGS. 3 and 4.

FIG. 2 is a top view of hatch assembly 10 in a closed and locked position. FIG. 3 is a side perspective view of hatch assembly 10 illustrating an exemplary latch assembly 40. FIG. 4 is a front perspective view of latch assembly 40 in a closed and locked position. FIG. 5 is a plan view of a portion of latch assembly 40.

Hatch assembly 10 includes a hatch cover or hatch 42 having a top surface 44, and an access port or hatch port 46 (shown in FIG. 3). Hatch 42 is adapted to cover hatch port 46 positioned at and in the top of car 20. Hatch port 46 is formed by a collar 48 that is inserted and secured within an opening in car 20. Hatch assembly 10 also includes a plurality of latch assemblies, such as latch assembly 40, mounted to hatch port 46 for securing and locking hatch 42 to hatch port 46.

Hatch 42 has a shape and size that is sufficient to cover hatch port 46 with which it is associated. As shown in FIGS. 2 and 3, hatch 42 is generally circular in shape, although hatch 42 may alternatively be octagonal or of other convenient shape. Hatch assembly 10 may be fabricated from materials such as, for example, carbon steel, stainless steel, an aluminum composite, or a mixture of similar materials.

In the exemplary embodiment, latch assembly 40 includes a wear plate 50 that is mounted on top surface 44 of hatch 42. In one embodiment, hatch 42 and wear plate 50 have a u-shaped cutout, and wear plate 50 is made from a durable material such as, for example, stainless steel. A cam mount 52, such as a pair of brackets, extend substantially perpendicular from hatch port 46. A first cam pin 54 is rotationally mounted to cam mount 52 about a pin axis 56 that is generally horizontal and/or parallel to railroad car top 32 where latch assembly 40 is mounted.

Latch assembly 40 includes a cam shaft 62, also referred to hereinafter as a bolt member. Cam shaft 62 has a base portion 64 and a threaded portion 66. Base portion 64 includes a bore 68 that is generally aligned with cam mount 52. Base portion 64 is pivotally connected to first cam pin 54 for rotation about pin axis 56. A centerline axis 70 extends between a first end 72 and a second end 74 of cam shaft 62. In the exemplary embodiment, base portion 64 is positioned proximate first end 72, and threaded portion 66 is positioned proximate second end 74.

Latch assembly 40 includes a securing member 80, such as, for example, a nut, which is coupled in a threaded relationship with bolt member threaded portion 66. Accordingly, the position of securing member 80 along bolt member 62 is adjustable along centerline axis 70. In one embodiment, centerline axis 70 is substantially perpendicular to pin axis 56. In the exemplary embodiment, securing member 80 has a plurality of corners, such as a hex-nut, and a plurality of sidewalls extending between the corners. In the exemplary embodiment, securing member 80 restricts movement of a cam member 82 in a direction that is generally away from first cam mount 52. As such, when latch assembly 40 is positioned over wear plate 50 and top surface 44 of hatch 42, securing member 80 restricts movement of cam member 82 away from hatch 42. Additionally, as securing member 80 is adjusted along threaded member 66 relatively closer to bolt member base portion 64, cam member 82 facilitates sealing hatch cover 42 with respect to hatch collar 48. In one embodiment, a motion limiting feature (not shown) is included to restrict removal of securing member 80 from bolt member 62. For example, a stopper (not shown) is coupled to second end 74 of bolt member 62, such as, for example, by a welding process. The stopper is configured to resist removal of securing member 80 from bolt member 62 and is intended to provide a "tamper-resistant" or "tamper-evident" hatch assembly 10.

As illustrated in FIG. 5, cam member 82 includes a lever portion 84 and a clevis portion 86. Clevis portion 86 is hingedly attached to cam shaft 62 by a second cam pin 88 (shown in FIG. 4). Specifically, cam shaft 62 extends through an opening in second cam pin 88 and securing member 80 holds second cam pin 88 on cam shaft 62. Additionally, second cam pin 88 extends through openings 90 in clevis portion 86. In one embodiment, openings 90 are substantially circular, which allows for rotational movement of cam member 82 about second cam pin 88.

In operation, second cam pin 88 facilitates hingedly or pivotally coupling clevis portion 86 of cam member 82 to bolt member 62 such that lever portion 84 of cam member 82 may be pivoted between an unlocked and a locked position (an example of which is illustrated in FIG. 3). In the locked position, cam member 82 is biased against wear plate 50 and secures hatch 42 in a closed position. In the unlocked position, the biasing force of cam member 82 on hatch 42 is released such that hatch 42 can be opened to allow access to hatch port 46. Additionally, in the unlocked position, cam member 82 is moveable between a neutral unlocked position and an engaged unlocked position, or engagement position, which will be described below. In one embodiment, lever portion 84 has a range of rotation about second cam pin 88 of approximately 180 degrees from the locked position to the engagement position.

In the example embodiment, clevis portion 86 also includes an opening 92 (shown in FIG. 5), which is configured to allow cam shaft 62 to extend therethrough. In one embodiment, opening 92 is elongated towards lever portion 84, which enables lever portion 84 to rotate about second cam pin 88 in the unlocked position. Specifically, opening 92 provides a space for bolt member 62 to pass through clevis portion 86 as lever portion 84 is rotated about second cam pin 88 over the approximately 180 degrees. Accordingly, when lever portion 84 is transferred from the unlocked position to the locked position, or vice-versa, the positioning of bolt member 62 within opening 92 of clevis portion 86 is altered.

In one embodiment, opening 92 has an engagement portion 94 configured to mate with securing member 80 for rotational movement of securing member 80 about the centerline axis 70 of bolt member 62. Specifically, engagement portion 94 interfaces with securing member 80 when cam member 82 is in the engagement position. This allows cam member 82 to adjust the threaded relationship between securing member 80 and threaded portion 66 for adjusting the distance between cam member 82 and hatch 42. For example, by adjusting the securing member 80 in a direction towards base portion 64 of bolt member 62, cam member 82 will be positioned relatively closer to hatch 42, thus increasing the biasing force of cam member 82 on hatch 42 when cam member is in the locked position. However, engagement portion 94 does not interface with securing member 80 when cam member 82 is in the neutral unlocked position, and thus, cam member 82 is moveable with respect to securing member 80 when cam member 82 is in the neutral unlocked position. For example, cam member 82 may be moved in the following directions in order to reposition cam member 82 with respect to securing member 80. Cam member 82 is movable in a rotational direction around centerline axis 70 extending through bolt member 62. Cam member 82 is movable in a rotational or pivotal direction around second cam pin 88. However, cam member 82 may be movable in other directions as well.

In the exemplary embodiment, engagement portion 94 is defined by opposed sidewalls 96 extending into opening 92. Sidewalls 96 are positioned on a bottom side of cam member 82 (i.e., the portion of cam member 82 positioned proximate hatch 42 when cam member 82 is in the locked position). When cam member 82 is in the locked position, engagement portion 94 is generally opposed to securing member 80. As a result, cam member 82 may be rotated the approximately 180 degrees or otherwise manipulated to move cam member 82 to the engagement position and thus engage securing member 80 with engagement portion 94 of cam member 82. In the exemplary embodiment, sidewalls 96 of engagement portion 94 are spaced apart a distance slightly greater than a distance between opposed sidewalls of securing member 80. As such, sidewalls 96 are configured to engage the sidewalls of securing member 80 for rotating securing member 80 upon rotation of cam member 82.

In other words, an exemplary method of use for hatch assembly 10 involves a user transferring cam member 82 from the locked position, in which securing member 80 bears against cam member 82 such that cam member 82 secures hatch 42 in a closed position, to an unlocked position. The user accomplishes this by rotating or pivoting lever portion 84 about second cam pin 88 to the neutral unlocked position. By transferring cam member 82 from the locked position to the unlocked position, the user can then rotate hatch 42 from hatch port 46 to allow access to compartments 34.

If, however, the user wishes to tighten or loosen the seal (i.e., a gasket) between hatch 42 and hatch collar 48, the user, after transferring cam member 82 from the locked position to the unlocked position, continues to rotate or otherwise manipulate cam member 82 to position cam member 82 into the engagement position. In the engagement position, engagement portion 94 of cam member 82 engages securing member 80 and cam member 82 is used to ratchet securing member 80 to either tighten or loosen securing member 80 with respect to bolt member 62. Specifically, securing member 80 may be rotated about bolt member 62 to adjust the position of securing member 80 along threaded portion 66 of bolt member 62. In operation, as securing member is moved relatively closer to base portion 64 of bolt member 62, cam member 82 is also moved relatively closer to hatch 42, thus tightening the locking force of cam member 82 on hatch 42. As securing member 80 is moved relatively away from base portion 64 of bolt member 62, cam member is also moved relatively away from hatch 42.

Moreover, to secure hatch 42 to hatch collar 48, cam member 82 is rotated about pin axis 56 until cam shaft 62 is substantially vertical and within u-shaped cutout, as shown in FIGS. 2 and 3. To lock hatch 42, cam member 82 must be biased against wear plate 50. To decrease the distance between cam member 82 and hatch 42, cam member 82 must be positioned relatively closer to hatch 42. As such, securing member 80 must be ratcheted and moved along threaded portion 66 of bolt member 62 to adjust the depth of securing member 80 on threaded portion 66.

Once securing member 80 is positioned on bolt member 62, cam member 82 is rotated to a position that is substantially centered with hatch 42 and pivoted about second cam pin 88 to the locked position. Adjusting the position of cam member 82 by adjusting the depth of securing member 80 with respect to bolt member 62 eliminates the need for an additional tool such as a ratchet or wrench normally carried by a user and utilized to adjust the position of cam member 82.

Once the desired position of cam member 82 and securing member 80 is achieved with respect to bolt member 62, cam member 82 is further pivoted about a bottom portion 98 of cam member 82 towards top surface 44 of hatch 42. Bottom portion 98 bears against wear plate 50 as cam member 82 is rotated from an unlocked position in which the lever portion 84 does not contact top surface 44 of hatch 42 to a locked position in which lever portion 84 is positioned along top surface 44 of hatch 42, as shown in FIG. 3. Adjusting the depth of securing member 80 using clevis portion 86 allows the user to control the positioning of cam member 82 during adjustment for insuring lever portion 84 of cam member 82 is centrally located on top surface 44 of hatch 42 before cam member 82 is pivoted into the locked position.

To open hatch 42 to gain access to hatch port 46, each latch assembly 40 must be rotated from the locked position to the unlocked position. Once each latch assembly 40 is moved to the unlocked position and rotated away from hatch 42, hatch 42 may be opened to allow access to hatch port 46.

In other words, the position of securing member 80 with respect to bolt member 62 is adjusted to tighten or loosen the seal between hatch 42 and hatch collar 48. Cam members 82 may be operated and hatch covers opened and closed without engaging securing member 80. Securing member 80 and engagement with clevis portion 86 of cam member 82 allows for gasket sealing adjustments with cam member 82 in lieu of a person having to carry a tool to the top of a railcar for such adjustment.

Figure 6:
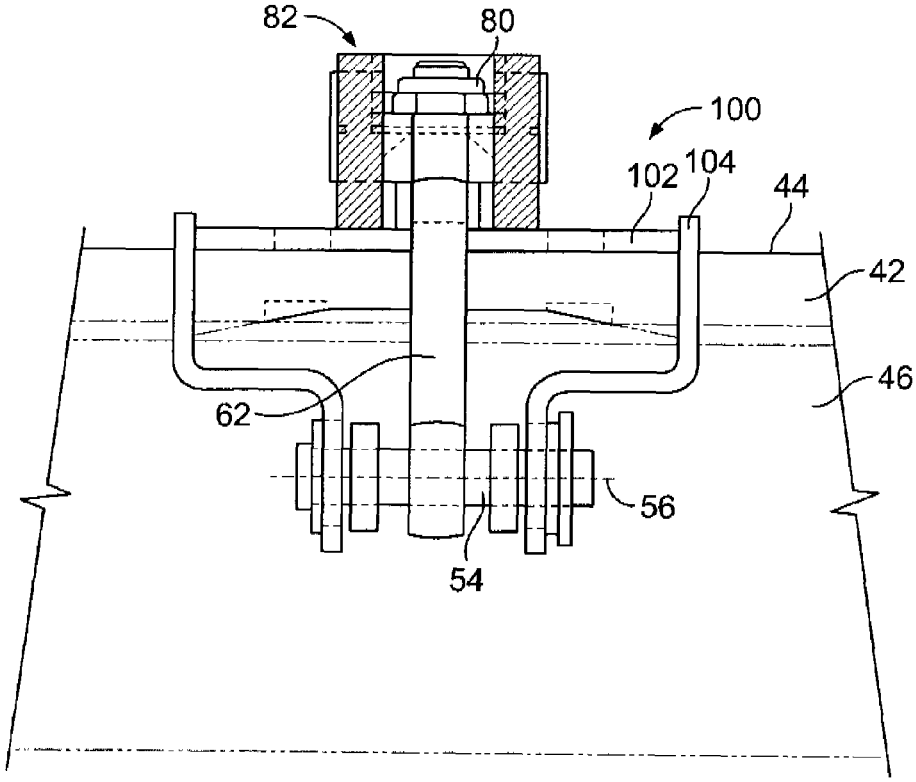
FIG. 6 is a front perspective view of an alternative embodiment of the latch assembly including a secondary latch shown on the example embodiment of the hatch assembly shown in FIG. 3.

FIG. 6 is a front perspective view of an alternative latch assembly 100 for hatch assembly 10. Latch assembly 100 is similar to latch assembly 40 (shown in FIGS. 3 and 4) except that latch assembly 100 includes a secondary latch 102. As such, like reference numerals of latch assembly 40 will be used to refer to the similar components of latch assembly 100.

Secondary latch 102 functions as a safety feature when opening hatch 42. For example, secondary latch 102 secures hatch 42 to hatch port 46 when cam member 82 is rotated from the locked position to the unlocked position. In other words, when cam member 82 is rotated from the locked position to the unlocked position, secondary latch 102 prevents hatch 42 from a forced opening which may result from compartments 34 being under pressure. Only upon removal of secondary latch 102 can hatch 42 be opened. In the exemplary embodiment, secondary latch 102 includes a pivoting arm assembly 104 pivotally mounted to first cam pin 54. Pivoting arm assembly 104 is rotated about pin axis 56 between a locked and unlocked position.

In operation, to secure hatch 42 to hatch port 46, pivoting arm assembly 104 is rotated on first cam pin 54 and secured along top surface 44 of hatch 42. Once pivoting arm assembly 104 is positioned, cam member 82 can be rotated from the unlocked position to the locked position. As such, secondary latch 102 provides a safety feature for hatch 42.

In addition, as described above, the depth of securing member 80 can be adjusted using clevis portion 86 of cam member 82 to tighten or loosen the seal between hatch 42 and hatch collar 48.

The above-described latch assembly is a cost effective and efficient means to secure a hatch cover over an opening in a vessel. The latch assembly includes a recess in the cam member for rotational engagement of a securing member without a separate tool. The latch assembly also allows for centering the cam member with respect to the top surface of the hatch before rotating the cam member into a locked position. As a result, the latch assembly facilitates adjusting the cam shaft without an extra tool in a cost-effective and time-saving manner.

Exemplary embodiments of a latch assembly are described above in detail. The systems are not limited to the specific embodiments described herein, but rather, components of each assembly may be utilized independently and separately from other components described herein. Each latch assembly component can also be used in combination with other latch assembly and hatch assembly components.

While the invention has been described in terms of various specific embodiments, those skilled in the art will recognize that the invention can be practiced with modification within the spirit and scope of the claims.

What is claimed is:

1. A hatch cover assembly for covering an opening in a vessel, wherein a hatch port extends outwardly about the opening, said hatch cover assembly comprising:

a hatch cover hingedly attached to said hatch port; and at least one latch assembly for fastening said hatch cover to said hatch port, said latch assembly further comprising:

a cam mount extending from said hatch port;

a first cam pin coupled to said cam mount, said first cam pin having a pin axis;

a bolt member comprising a first end and a second end, said bolt member having a centerline axis extending between said first end and said second end, said centerline axis generally perpendicular to said pin axis, said first end hingedly attached to said first cam pin about said pin axis;

a securing member in threaded relationship with said bolt member second end, said securing member rotatable about the centerline axis of said bolt member; and a cam member comprising a cam lever portion and a clevis portion, said clevis portion comprising a pair of first openings for receiving a second cam pin, said second end of said bolt member extending substantially perpendicular through said second cam pin for securing said cam member to said bolt member, said cam member coupled to said bolt member by said securing member, wherein said clevis portion further comprises an engagement portion having spaced apart sidewalls and a second opening, said clevis portion configured to be variably positionable between a first and a second position such that said securing member is positioned within said second opening of said clevis portion when said clevis portion is in the first position and said engagement portion engages said securing member when said clevis portion is in the second position, and wherein said cam member configured to engage said securing member and adjust the threaded relationship of said securing member with respect to said bolt member by rotating said lever portion about the centerline axis of said bolt member.

2. A hatch cover assembly according to claim 1 further comprising a secondary latch comprising an arm pivotally mounted to said cam mount about said pin axis, said secondary latch pivotal from an unlocked position in which said arm does not contact said hatch to a locked position in which said arm contacts said hatch.

3. A hatch cover assembly according to claim 1 wherein said cam member is rotatable about said second cam pin to engage said securing member.

4. A hatch cover assembly according to claim 1 wherein said lever portion is configured to be rotated about the first axis to adjust the threaded relationship between said securing member and said bolt member when said clevis portion is in the second position.

5. A hatch cover assembly according to claim 1 wherein said securing member comprises a nut comprising a plurality of sidewalls, said clevis portion comprises an engagement portion configured to receive at least two of said sidewalls, said engagement portion is configured to engage said sidewalls such that said cam member rotates said nut when said lever portion is rotated about said centerline axis.

6. A hatch cover assembly according to claim 5 wherein said engagement portion comprises opposed wall portions for contacting said sidewalls of said nut.

7. A hatch cover assembly according to claim 1 wherein said cam lever portion is movable with respect to said securing member in at least one of a rotational direction around said centerline axis extending through said securing member, in a pivotal direction generally towards said hatch cover, and in a pivotal direction generally away from said hatch cover.

8. A latch assembly comprising:

a cam mount comprising a first cam pin extending therethrough;

a cam shaft comprising a first end and a second end, said cam shaft having a centerline axis extending between said first end and said second end, said first end comprises an opening for receiving said first cam pin and for securing said cam shaft to said cam mount, said second end comprises a threaded portion for threaded engagement with a securing member; and a cam member comprising a lever end, a clevis end and a cam member axis extending therebetween, said clevis end comprising a pair of cam pin openings for receiving a second cam pin and a cam shaft opening, said second end of said cam shaft extending substantially perpendicular through said second cam pin, said cam shaft opening including an engagement portion sized to receive said securing member and said securing member configured to couple said cam member to said cam shaft, said engagement portion is configured to engage said securing member such that said cam member rotates said securing member when said lever portion is rotated about said centerline axis for adjusting the threaded relationship between said cam shaft and said securing member.

9. A latch assembly according to claim 8 wherein said cam member is movable with respect to said securing member in at least one of a rotational direction around said centerline axis extending through said securing member, in a rotational direction around said cam member axis, and in a pivotal direction generally perpendicular to said cam member axis.

* * * * *